United States Patent [19]

Heiser

[11] 4,066,006

[45] Jan. 3, 1978

[54] FLOW REGULATING SYSTEM

[75] Inventor: Joachim Heiser, Stuttgart, Germany

[73] Assignee: Robert Bosch G.m.b.H., Stuttgart, Germany

[21] Appl. No.: 641,701

[22] Filed: Dec. 17, 1975

[30] Foreign Application Priority Data

Dec. 21, 1974 Germany ..... 2461021

[51] Int. Cl.[2] ..... F15B 13/043

[52] U.S. Cl. ..... 91/433; 91/445; 91/447

[58] Field of Search ..... 91/433, 445, 447, 448; 137/625.63, 625.62, 85

[56] References Cited

U.S. PATENT DOCUMENTS

| | | | |
|---|---|---|---|
| Re. 24,002 | 5/1955 | Beck | 91/433 X |
| 2,644,482 | 7/1953 | McCallum | 137/501 |
| 2,976,848 | 3/1961 | Place | 91/445 X |
| 3,038,498 | 6/1962 | Spavey | 137/85 X |
| 3,095,906 | 7/1963 | Kolm, Jr. | 137/625.62 |
| 3,126,031 | 3/1964 | Hayner | 137/625.62 |
| 3,213,886 | 10/1965 | Pearne | 91/447 X |
| 3,230,841 | 1/1966 | York | 137/625.66 X |
| 3,375,659 | 4/1968 | Ray | 91/47 X |
| 3,763,746 | 10/1973 | Walters | 91/433 |
| 3,799,200 | 3/1974 | Tipton | 91/433 X |
| 3,859,791 | 1/1975 | Allen et al. | 91/433 X |
| 3,865,014 | 2/1975 | Van der Kolk | 91/433 X |

*Primary Examiner*—Irwin C. Cohen
*Attorney, Agent, or Firm*—Michael J. Striker

[57] ABSTRACT

A main valve controls the flow to a load in a first or second direction depending upon the signal applied to a pilot valve. A spool of the main valve is biased to a central position blocking flow by springs. A throttle valve having an adjustable restrictor area is connected in one line between the main valve and the load. The restrictor area is adjusted in correspondence to an input signal. The spool is moved to a first or second extreme position by the pilot valve. The pressure difference developed across the throttle valve is applied to the spool in a direction to force the spool towards the central position. The spool is balanced at a predetermined pressure difference across the throttle valve. A relief valve is furnished in an inlet line to the main valve so that a reversal of pressure medium flow through the load causes an excess pressure difference across the throttle valve and thereby moves the main valve spool to the other of its two operating positions in turn causing a substantial pressure increase in the inlet line causes operation of the relief valve and thereby braking of the load.

15 Claims, 2 Drawing Figures

FLOW REGULATING SYSTEM

BACKGROUND OF THE INVENTION

The present invention relates to systems for controlling the flow of pressure medium to a hydraulic load. In particular it relates to systems for controlling a hydraulic control member itself constituting the hydraulic load by means of a main valve which determines the direction of flow to the load under control of a pilot valve, flow control means also being provided.

In a known system of the above-described type, a flow sensor is disposed in the outlet line connecting the outlet port of the main valve to the receptacle receiving the pressure medium. In this flow sensor, the magnitude of the pressure difference corresponds to the amount of flow therethrough. This has the distinct disadvantage, when the regulatory region is large, the accuracy for small flows is very small due to the hysteresis of the sensor and because in this case absolute values are being dealt with. A further disadvantage is that the system is not readily adaptable to various commercial applications, for example to applications wherein only a predetermined number of different flows are required. These systems are further subject to malfunction and require a relatively high manufacturing accuracy. Further, the pilot valve operates in an analog fashion and thus makes the arrangement expensive.

SUMMARY OF THE INVENTION

It is an object of the present invention to furnish a system of the above-described type which does not have the above-mentioned disadvantages. Specifically, the accuracy of the flow is to be high over the whole control region.

The present system is a system for controlling the flow of pressure medium to a load to a selected one of at least a first and a second desired flow in response to an input signal signifying said selected one of said first and second desired flows. It comprises a source of pressure medium and receptacle means for receiving pressure medium. It further comprises main valve means having an inlet port connected to said source of pressure medium, an outlet port connected to said receptacle means, a first and second load supply port, a flow control member, and pressure responsive means for positioning said flow control member to control the flow to said load in correspondece to a pressure difference applied thereto. The system of the present invention further comprises a first and second load line respectively interconnected between said first and second load supply ports and said load. Throttle means are connected in said first load line for restricting the flow of said pressure fluid therein, whereby a pressure difference is created across said throttle means, said throttle means having a restrictive section adjustable to at least a first or a second area. Throttle adjustment means are supplied for adjusting said restrictive section of said throttle means to said first or said second area under control of said input signal. Further, means are provided for applying said pressure difference developed across said throttle means to said pressure responsive means of said main valve means, whereby said flow to said load varies as a function of said area of said restrictive section and thereby as a function of said input signal.

The above-described system operates in such a manner that the pressure difference across the throttle means is maintained constant, the system thereby responding to differences between the actual flow and the desired flow, rather than to absolute values. Further, the spool of the main valve (herein referred to as the flow control member) serves as a manometer. The accuracy of the flow is, since only flow differences are sensed, equally good for small flows and for large. Further, the arrangement may be constructed from elements having only standard accuracy requirements and the system is readily adaptable for different applications. For example, the throttle means may have an area which is adjustable either step-by-step or continuously, allowing adjustment to either a predetermined number of desired flows or a continuous flow adjustment.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
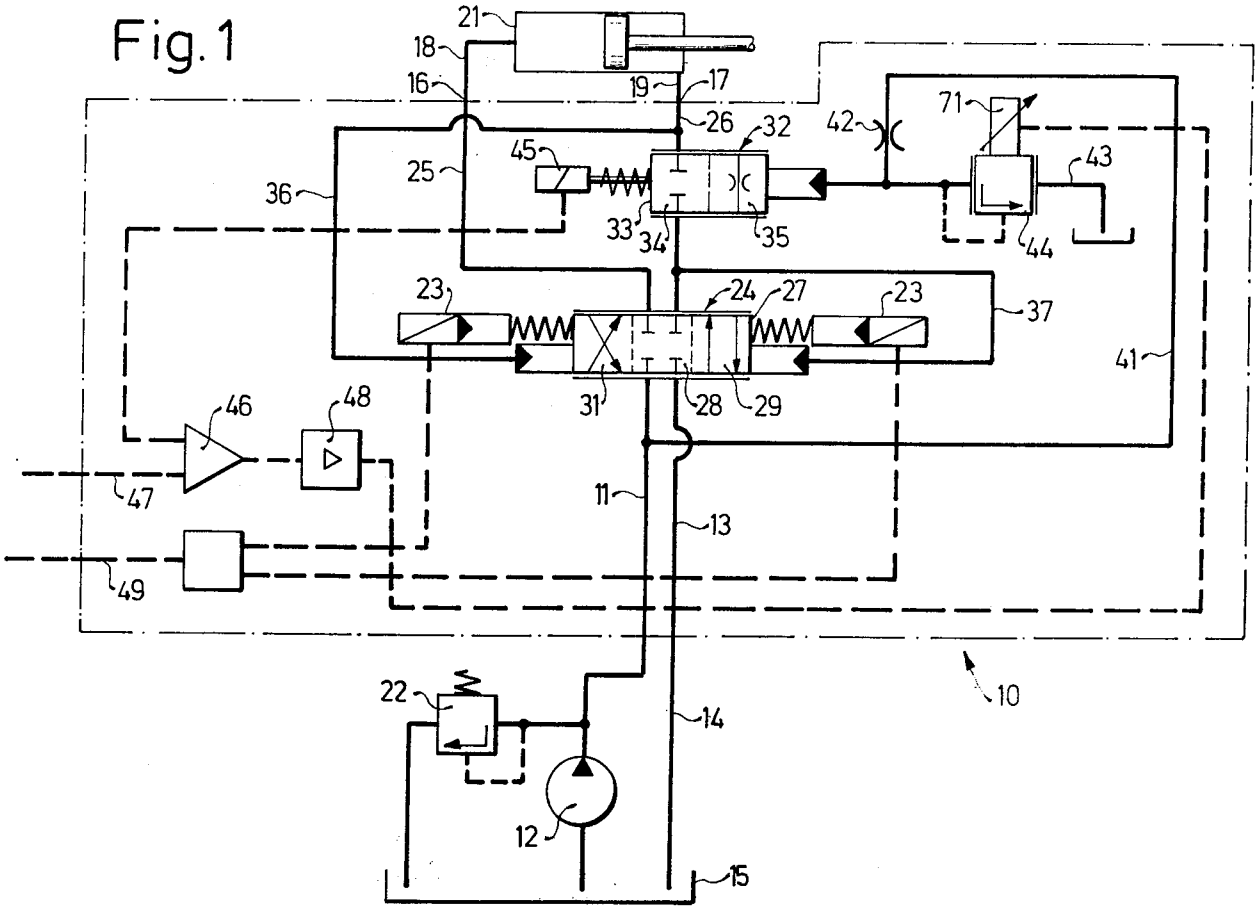
FIG. 1 is a schematic diagram showing a hydraulic system in accordance with the present invention.

A preferred embodiment of the present invention will now be described with reference to the drawing.

FIG. 1 shows the overall control system 10 which has an inlet line 11 receiving pressure medium from a pump 12 and an outlet line 13 connected through a line 14 to a receptacle 15. A first and second load supply port are labelled 16 and 17 respectively. Ports 16 and 17 are, respectively, connected through a first and second load line 18 and 19, to the load 21 which is a hydraulic flow member. A relief valve 22 is connected to inlet line 11.

System 10 comprises a pilot valve 23 which controls a main valve 24. The main valve 24 is connected through lines 25 and 26 to ports 16 and 17. Main valve 24 is a four-way three-position valve. Spool 27 can assume a central position 28 and a first or second operating position 29 and 31 as well as intermediate positions. Throttle valve 32, a preferred embodiment of throttle means, is connected in line 26. Throttle valve 32 comprises a slider 33 which can assume a number of intermediate positions between a blocking position 34 and a full open position 35. The pressure difference developed across the throttle valve is applied through control lines 36 and 37 to main valve 24 in such a manner that the spool 27 of main valve 24 is always pushed thereby towards the central position 28. The throttle valve slider 33 is hydraulically operated in opposition to the force of a spring 38 (see FIG. 2). A pressure chamber 39 is provided for this purpose which is connected through a line 41 including a throttle 42 to the inlet line 11 and through a line 43 to the receptacle 15. Line 43 has a pressure regulating valve 44 disposed therein. Further, the throttle valve slider 33 is connected with a position sensor 45 which operates on the inductive principle. The electrical signals furnished by sensor 45 are compared in an electrical comparator circuit 46 (in a preferred embodiment a differential amplifier) with the desired value which is applied at an input 47 of comparator 46. The difference between the two signals is amplified in an amplifier 48 and is used to control the pressure regulating valve 44. Terminal 49 is furnished to receive the direction signal which operates pilot valve 23 and thereby the main valve to control the direction of flow of the pressure medium.

Figure 2:
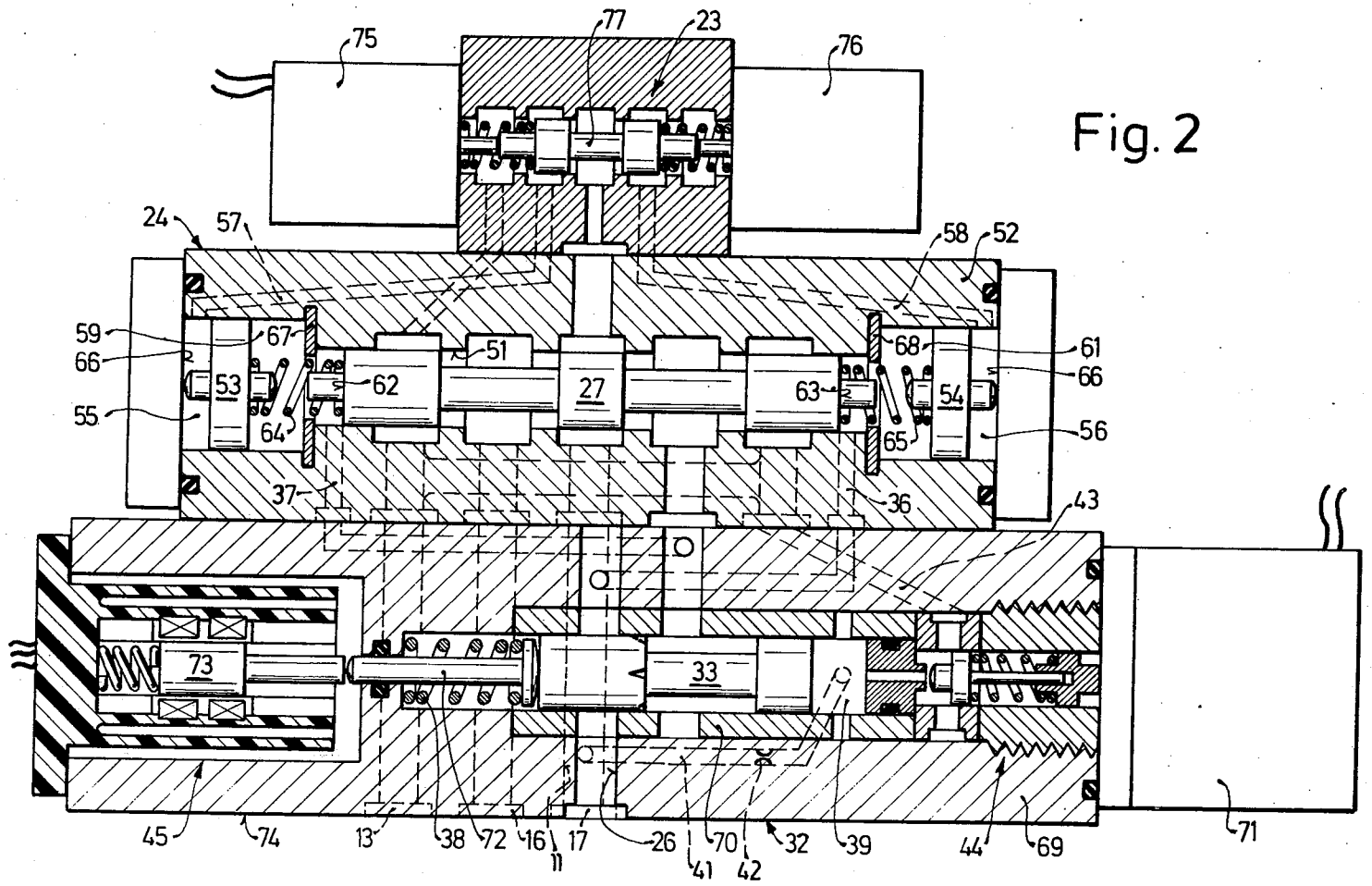
FIG. 2 is a cross-section of the system shown in FIG. 1.

As shown in greater detail in FIG. 2, the spool 27 of main valve 24 is slidably mounted in a bore 51 of a housing 52. Housing 52 has end portions of increased width in which pistons 53 and 54 are slidably disposed. The pistons are liquid tight relative to the housing. Thus pressure chambers, herein referred to as first pressure chambers and labelled 55 and 56 are formed which are connected with pilot valve 23 through first and second pilot lines labelled 57 and 58 respectively. A pair of second pressure chambers, labelled 59 and 61 are formed by the second side of pistons 53 and 54 and a pressure receiving surface 62 and 63 of spool 27. Springs 64 and 65 are disposed in the second pressure chambers. The latter tend to push pistons 53 and 54 against stops 66 which are rigidly mounted on the housing and thereby center the spool 27 in the central position 28. The second pressure chambers 59 and 61 contain snap rings 67, 68 respectively, which serve as a stops for pistons 53 and 54 as well as spool 27. A line 37 connects the second pressure chamber 59 to the part of line 26 disposed between the main valve 24 and throttle valve 32. Similarly, the second chamber 61 is connected through a line 36 to the port 17 in housing 69 of throttle valve 32. Housing 69 receives slider 33 in a hub 70 which also contains the pressure chamber 39. A pressure regulating valve 44 is mounted coaxially to slider 33 and is operated by a proportional solenoid 71. A stem 72 acted upon by the force of a spring 38 tends to push slider 33 to the blocking position 34. The slider 33 has a large positive overlap when in blocking position 34. The position sensor 45 which works on the inductive principle, is positioned on the opposite side to pressure regulating valve 44 and coaxially to slider 33. The inductive sensor has a movable spring-loaded portion 73 which abuts against stem 72. The inlet line 11 and outlet line 13 of main valve 24 pass through housing 69 and terminate in its flange 74 in which the load ports 16 and 17 can also be found. Pilot valve 23 is flange mounted on housing 52 on the side opposite that of throttle valve 32. The pilot valve selectively connects lines 57 and 58 to inlet line 11 or outlet line 13 while, in the center position, blocking inlet line 11 and causing lines 57 and 58 to be connected to the outlet line 13. Pilot valve 23 is a four-way three-position valve whose slider 77 is operable by electromagnets 75 and 76.

The above-described arrangement operates as follows:

First, the input signal, which is a signal signifying the desired flow, is applied to terminal 47, while terminal 49 receives a signal signifying the direction of flow to load 21. For direction control, let it first be assumed that electromagnet 76 causes slider 77 to be moved towards the left from the position shown in FIG. 2. This causes pressure medium from inlet line 11, in which pump 12 maintains a constant pressure, to be supplied through line 57 into the left-most first pressure chamber 55. This causes piston 53 to be moved towards the right in FIG. 2 until it hits the stop provided by snap ring 67. Spring 64 causes spool 27 to be moved to the right into its first operating position 29 in which it abuts against the snap ring 68. Simultaneously, the slider 77 causes the first pressure chamber 56 to be connected to outlet line 13 so that pressure medium is removed therefrom. This causes piston 54 to abut against stop 66. Slider 27 causes inlet line 11 to be connected to port 16 and line 26 to outlet line 13.

Simultaneously, throttle valve 32 in line 26 is controlled in accordance with the electrical input signal. For this purpose, electromagnet 71 is energized and the pressure regulating valve 44 controls the pressure in pressure chamber 39 in proportion to the current applied thereto. Corresponding to this pressure, the slider 33 is moved against the force of spring 38 and assumes a determined position wherein the cross-sectional area (restrictor area) is proportional to the amplitude of the electrical input signal. Pressure medium flows from load 21 to line 19, port 17, line 26, throttle valve 32, main valve 24, outlet line 13 and line 14 back to receptacle 15. The pressure established by slider 33 is applied through line 36 into the second chamber 61 while the pressure downstream of slider 33 is applied through line 37 into the second chamber 59. Thus the pressure difference appearing across the slider 33 is applied to spool 27 in a direction opposing the initially applied forces and the force of springs 64 and 65 and tends to push spool 27 from its first operating position 29 into the central position 28 until equilibrium has been achieved. The spring constant of springs 64 and 65 is so chosen relative to the given distances between pistons 53 and 54 and spool 27, that a predetermined pressure difference exists across the throttle valve 32 when equilibrium is reached. In a preferred embodiment of the present invention this pressure difference is 10 bar. This pressure difference thus exists independently of the size of the throttle cross-section and thereby independently of the flow to the load, so that the accuracy of the arrangement is the same over the whole regulating region.

If the direction of flow is reversed, the electromagnet 75 is energized which causes the slider 77 to move towards the right (as shown in FIG. 2) and the spool 27 to be moved to the left to the second operating position 31. The pressure medium then flows from inlet line 11 through throttle valve 32 to load 21. It will be noted that the pressure difference across throttle valve 32 automatically changes sign and the force is thus automatically applied to spool 27 in the opposite direction. Here too the spool acts as a manometer.

The movement of slider 33 is transmitted through stem 72 to the movable portion 73 of the position sensor 45. The output signal of position sensor 45 is comparable with the reference value in comparator 46. The amplifier 48 amplifies the difference signal and, with this error signal, controls the proportional electromagnet 71. The throttle cross-section can therefore be exactly and reproducably regulated.

Further, it is desirable that a great positive overlap exists when throttle slide 33 is in its blocking position 34. The losses due to leaking of load 21 are thus maintained at a low level. The load for the control member 21 which serves as the load for the present invention can then be hydraulically applied.

A further advantage of the system designated by reference numeral 10 is that it can also function as a brake. If for example the hydraulic load applied to control member 21 reverses, which is of course an undesired condition, the spool 27 which is acting as a manometer can be pushed from its then present operating position (29 or 31) through the central position 28 into the other operating position (31 or 29) respectively, if the pressure difference developed across throttle valve 33 exceeds the desired pressure difference of 10 bar. This causes inlet 9, 11 to be directly connected to the line 25 or 26 which is in itself under pressure. The excessive pressure thereby created in line 11 causes relief valve 22 to open which causes pressure medium to be discharged and the load to be braked. During this braking operation, the piston 53 or 54 which is under pressure through pilot valve 23 is pushed to the corresponding snap ring 67 or 68, since the force developed in the corresponding one of pressure chamber 55 or 56 exceeds the opposing forces. For the function as a braking valve, it is very desirable that spool 27 has little negative overlap. The system of the present invention is readily adaptable for use when the load to be controlled utilizes a plunger-type piston whose two effective surfaces are unequal. If such a load is being controlled, the quantity of pressure medium which flows into the side of the cylinder wherein the plunger is located is less than flows out of the opposite side. However, the stroke for each of the control edges is the same in spool 27 of the present invention. For spool 27, on a simplified basis, it may be said that the flow (quantity of pressure medium) Q over a particular control edge is equal to the product of the controlled cross-sectional area $a$ multiplied by the square root of the pressure difference $p$. This $p$ is to be the same for the intake and outlet edges. Since however the inlet Q is different from the outlet Q at the load, the cross-sectional areas $a$ at the intake and outlet edge must have the same relationship as the effective piston areas on the plunger-type cylinder being controlled. This can be accomplished by corresponding slits or fine adjustment grooves in spool 27, which cause a suitable adjustment of the cross-sectional area $a$ throughout the stroke. A compensation of the differences in the effective areas of the cylinder using a plunger-type piston can thus readily be effected by the present invention.

The above consideration shows that in accordance with the present invention the function of directional control, flow control and braking can all be fulfilled by the main valve.

Of course, it is possible that variations can be made in the above-described equipment without departing from the basic thought of the present invention. For example an inductive position sensor may be omitted when the requirements for accuracy are not particularly high. It is further, of course, not necessary that slider 33 of throttle valve 32 is hydraulically controlled. It can be controlled directly either magnetically, mechanically or pneumatically. For many cases it is further sufficient that, instead of a continuous control, only a plurality of individual predetermined flows can be established. In such a case it is particularly desirable that instead of a single continuously variable throttle valve 32, two individual valves are provided which are connected in parallel and which are selectively connected into the arrangement in dependence upon the desired flow. A greater plurality of throttle valves can of course be provided for a digitally operating system. Such changes can readily be carried out on the equipment because of its block-by-block construction.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In combination with a pressure-responsive actuator having a pair of connections pressurizable for operating said actuator, a hydraulic system comprising:

first and second load supply lines each connectable to a respective one of said connections;

a source of fluid under pressure having a high-pressure side and a low-pressure side;

a main control valve connected between said load supply lines and said source and having a movable control member displaceable between a first end position connecting said first line to said high-pressure side and said second line to said low-pressure side, a second end position connecting said second line to said high-pressure side and said first line to said low-pressure side, and an intermediate central position blocking fluid flow between said high-pressure and low-pressure sides and said supply lines, said control valve having means including a pair of oppositely effective springs bearing on said member for urging said member into said central position;

means responsive to a direction signal and including a pilot valve connected to said member of said main control valve for displacing same into one of said end positions in dependence upon said direction signal;

a restriction in one of said load supply lines and forming a variable flow passage displaceable between a relatively wide position and a relatively narrow position, whereby the pressure differential across said restriction is greater in said narrow position than in said wide position;

pressure-responsive means connected to said one load supply line to both sides of said restriction and connected to said main control valve for applying the pressure differential across said restriction to said main control valve in said first position thereof in a direction urging said main control valve into said second position and in said second position thereof in an opposite direction urging said main control valve into said first position, said pressure-responsive means including a pair of pistons bearing each in a respective direction through a respective spring on said member and each having an inner face turned toward said member and engaging the respective spring and an outer face turned away from said member, a pair of inner chambers each between a respective inner face and said member, and a pressure line between each of said inner chambers and a respective side of said restriction; and electrical actuating means connected to said restriction for generating an input signal and displacing said restriction between said wide and narrow positions therewith, said direction signal responsive means including a pair of outer chambers each at a respective outer piston face and a pressure line between each of said outer chambers and a respective portion of said pilot valve.

2. The system defined in claim 1 wherein said main control valve includes a housing having a pair of end stops each engageable with a respective inner face.

3. The system defined in claim 2 wherein said control member engages a respective one of said stops in each of said end positions.

4. In a combination with a pressure-responsive actuator having a pair of connections pressurizable for operating said actuator, a hydraulic system comprising:

first and second load supply lines each connectable to a respective one of said connections;

a source of fluid under pressure having a high-pressure side and a low-pressure side;

a main control valve connected between said load supply lines and said source and having a movable control member displaceable between a first end position connecting said first line to said high-pressure side and said second line to said low-pressure side, a second end position connecting said second line to said high-pressure side and said first line to said low-pressure side, and an intermediate central position blocking fluid flow between said high-pressure and low-pressure sides and said supply lines, said control valve having means including at least one spring bearing on said member for urging said member from a one of said end positions into said central position;

means responsive to a direction signal and including a pilot valve connected to said member of said main control valve for displacing same into one of said end positions in dependence upon said direction signal;

a restriction in one of said load supply lines forming a variable flow passage therein and displaceable between a relatively wide position and a relatively narrow position, whereby the pressure differential across said restriction is greater in said narrow position than in said wide position;

pressure-responsive means connected to said one load supply line to one side of said restriction and connected to said main control valve for applying the pressure at said one side of said restriction to said main control valve in said one end position thereof in a direction urging said main control valve into the other end position, said pressure-responsive means including a piston having an inner face bearing via said spring on said member and an outer face turned away from said member, an inner chamber between said inner face and said member, and a pressure line between said inner chamber and said one side of said restriction; and electrical actuating means connected to said restriction for generating an input signal and displacing said restriction between said wide and narrow positions therewith, said direction signal responsive means including an outer chamber at said outer piston face and a pressure line between said outer chamber and said pilot valve.

5. The system defined in claim 4 wherein said restriction is continuously adjustable between said wide and narrow positions.

6. The system defined in claim 5 wherein said restriction includes a throttle valve having a slider displaceable between said wide and narrow positions and into a blocking position preventing fluid flow through said one load supply line, and spring means for urging said slider into said blocking position.

7. The system defined in claim 6 wherein said throttle valve has a pressure chamber and said slider has a pressure-receiving surface constituting one wall of said pressure chamber, said electrical actuating means including a pressure control valve between said chamber and said source for establishing a pressure in said pressure chamber corresponding to said input signal.

8. The system defined in claim 7 wherein said electrical actuating means includes a throttle between said pressure-control valve and said high-pressure side.

9. The system defined in claim 7 wherein said electrical actuating means includes inductive position-detecting means connected to said slider for generating an output corresponding to the position of said slider, means for comparing said output with a reference value, and for generating an error signal corresponding to the difference between said value and said output, and means for actuating said pressure-control valve in accordance with said error signal.

10. The system defined in claim 9 wherein said pressure-control valve includes solenoid means for opening said pressure-control valve to an extent proportional to the amplitude of said error signal.

11. The system defined in claim 10 wherein said pressure control valve and said electrical actuating means have a common housing.

12. The system defined in claim 11 wherein said main control valve has a housing flange-mounted on said common housing.

13. The system defined in claim 4, further comprising a relief valve between said high-pressure and low-pressure sides, and set to open at a pressure smaller than the pressure developed on reversal of flow through said load causing increasing of said pressure differential and displacement of said control member from one to the other of its end positions and simultaneous increasing of the pressure at said high-pressure side.

14. The system defined in claim 4 wherein said actuator is a ram having a piston and pressurizable compartment to each side of said piston connected to a respective one of said load lines, said piston having a greater effective area in one of said compartments than in the other of said compartments.

15. The system defined in claim 4 wherein said main control valve has a housing and said control member is formed with small negative overlap relative to said housing.

* * * * *